United States Patent [19]

Goldfarb et al.

[11] 4,037,840

[45] July 26, 1977

[54] TOY GAME DEVICE AND METHOD

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe, both of Northridge, Calif.

[21] Appl. No.: 657,379

[22] Filed: Feb. 12, 1976

[51] Int. Cl.[2] ..... A63F 7/06

[52] U.S. Cl. ..... 273/85 A; 273/120 R; 273/125 R

[58] Field of Search ..... 273/85 A, 85 B, 120, 273/122, 123, 125, 129 E, 129 HA, 129 HB, 85 E

[56] References Cited

U.S. PATENT DOCUMENTS

| | | | |
|---|---|---|---|
| 854,581 | 5/1907 | Kohler | 273/123 R |
| 1,877,230 | 9/1932 | De Pew | 273/125 R |
| 3,029,078 | 4/1962 | Frigo | 273/125 R |
| 3,901,508 | 8/1975 | Spangler | 273/85 E |

FOREIGN PATENT DOCUMENTS

| | | | |
|---|---|---|---|
| 2,527,782 | 1/1976 | Germany | 273/85 A |
| 694,035 | 7/1940 | Germany | 273/120 R |
| 508,532 | 1/1955 | Italy | 273/85 A |
| 265,411 | 2/1927 | United Kingdom | 273/123 R |
| 567,919 | 3/1945 | United Kingdom | 273/85 A |

OTHER PUBLICATIONS

"Hockey Game;" *Gotham Pressed Steel Corp.;* 3-1970.

*Primary Examiner*—Anton O. Oechsle
*Assistant Examiner*—Harry G. Strappello
*Attorney, Agent, or Firm*—Robert M. Ashen; Robert J. Schaap

[57] ABSTRACT

A toy game apparatus including a game playing board with a retaining wall extending around the playing board for retaining a playing surface of complex curvature with a pair of spaced apart recessed goals located at low areas in the playing board and with the game board having inclined walls leading from the center of the board and the periphery of the board to the pair of recessed goals. In this way, the portions of the game board surrounding the goal areas converge downwardly and inwardly toward the recessed goals so that a playing piece on the game board can enter the goals through arcuate paths and at any point around the entire periphery of the goals and from any direction. A goal cup is rotatably mounted in each of the goal recesses and a striker member is operatively connected to the goal cup for rotation therewith. A mechanical linkage connects each of the goal cups to associated actuating arms which are located at each of the player ends of the game board so that movement of an actuating arm will cause rotation of the connected goal cup and the striker member associated therewith. The striker members are located at the periphery of the goal cups so that they can defend the goals from any point around the periphery of the goals. A transparent cover extends over the playing board so that the playing piece is always retained therein, and when the playing piece enters a goal cup, it will pass through a discharge duct to the exterior of the game apparatus for reinsertion onto the playing board. In accordance with this game construction, the playing piece will always enter one or the other of the goals unless the player actuates the striker member in order to propel the playing piece away from its associated goal.

22 Claims, 5 Drawing Figures

TOY GAME DEVICE AND METHOD

BACKGROUND OF THE INVENTION

This invention relates in general to certain new and useful improvements in toy game apparatus and methods of playing the same and, more particularly, to such toy game apparatus and method which includes a playing surface of configuration such that a playing piece can move toward a goal area in an arcuate path and enter the goal area from any point around the entire periphery of the goal area and from any direction if positive repelling action of the playing piece is not performed by a player.

There are a large number of commercially available games where a pair of opposed goal areas are formed in a game board and which goal areas are defended by a movable striker member. For example, there are several forms of simulated hockey games where a striker member, representative of a goalie, is capable of moving in front of a goal area in order to defend the goal area. This goalie, or striker member, includes a paddle-like device which is capable of engaging the playing piece to repel the same when the playing piece is moved toward the particular goal area.

In some of these commercially available game devices, the game board is inclined toward the goal areas so that if one player does not take any positive action to repel the playing piece moving toward his goal area, the playing piece will automatically enter the goal area. In many of these game devices, the goal was open only on one side, as for example, the front of the goal facing the center of the game board was open to receive a playing piece. The striker member was therefore only movable laterally or pivoted about a fixed axis in front of the open side of the goal area. Thus, for example, the playing piece could travel around to the back side of the goal area, but could not enter the goal area from such position, so that it was only necessary to defend the goal area from the limited open area.

In view of these game designs, a large degree of skill was not required to play the game due to the fact that each player was only required to defend his goal area from one side. In addition, the amount of strategy which could be used in the playing of the game was also limited since the playing piece could only approach the goal areas from a limited number of directions.

The present invention obviates these and other problems in the provision of a game apparatus which includes a playing board having a pair of opposed recessed goal areas in the game board. The board is of complex curvature such that the goal areas are located at low points in the game board, and the portions of the game board surrounding the goal areas converge downwardly and inwardly into the goal areas. In addition, the portions surrounding the goal areas are essentially conical in shape so that the playing piece can move downwardly toward the goal areas through arcuate paths surrounding the goal areas and can enter the goal areas from any point on the entire periphery of the goal areas and from any direction unless positive repelling action is taken by a defending player.

It is, therefore, a primary object of the present invention to provide a toy game apparatus constructed in such manner that a playing piece can move into one or another of a pair of goal areas from any point around the entire periphery of each of the goal areas and from any direction unless the defending player takes positive action to propel the playing piece away from the goal area.

It is another object of the present invention to provide a toy game apparatus of the type stated which includes a playing board of complex curvature and with goal areas located in recessed portions of the game board.

It is a further object of the present invention to provide a toy game apparatus of the type stated in which a playing piece may move through an arcuate path toward its entry into a goal area.

It is an additional object of the present invention to provide a toy game apparatus of the type stated which is designed so that skill and strategy must be used by the players in the playing of the game.

It is another salient object of the present invention to provide a toy game apparatus of the type stated which is of rigid and durable construction.

It is also an object of the present invention to provide a method of playing a toy game in which the players must take positive action to defend their own goal areas to prevent a playing piece from entering a goal area from any point on the entire periphery of the goal area and from any direction.

With the above and other objects in view, our invention resides in the novel features of form, construction, arrangement and combination of parts presently described and pointed out in the claims.

SUMMARY OF THE DISCLOSURE

A toy game apparatus for engaging and propelling a playing piece into a goal of an opponent player. The game apparatus generally includes a playing board having a retaining wall extending around the playing board for retaining a playing piece thereon. In a preferred aspect of the present invention, a cover, which may be of a transparent construction, extends over the playing board to prevent the players from manipulating the playing piece, other than by means of the use of striker members. Entry and exit means for the playing piece are also provided.

The game playing board includes a pair of recessed goals in the game board and the game board is of complex curvature and the goals are located at low areas in the game board. The game board comprises a pair of conically shaped sections having walls which converge downwardly and inwardly into the associated goals so that the playing piece can move toward the goals through arcuate paths surrounding the goal areas. The goals are open on their entire periphery so that a playing piece can enter the goals from any point on their periphery and, moreover, can enter the goals from essentially any direction around the periphery.

The apparatus of the present invention also utilizes a striker means which is operatively associated with the goals. The striker means are essentially rotatable about the goals for the entire peripheral length of the goals, and are actuated if a playing piece is approaching the goal area. If the player does not actually engage and propel the playing piece by the striker member, so that it is moved away from the goal area, it will automatically fall into the goal area due to the inclined nature of the playing surface surrounding the goal areas.

The game apparatus of the present invention can be further characterized in that the striker means are manually actuable from the exterior of the apparatus. Furthermore, the goals each comprise an individual cup-like member, and the striker members in this case are attached to the cup-like members for rotational movement thereabout. In addition, a discharge means for removing the playing piece, which may be in the form of a ball, from the goal cup comprises a ductwork which communicates with the goal cup through an aperture in the goal cup so that the playing piece may be transferred to the exterior of the game board and may be reintroduced through a slot in the transparent cover.

The toy playing game of the present invention is designed so that it can simulate a toy tennis game. However, it should also be understood that the game apparatus could be constructed to simulate other forms of toy playing games.

The striker members are manually operable as indicated above, and an individual manually operable actuating member is associated with each of the cup-like members. A first gear means is located on a portion of the actuating member inwardly of the peripheral margin of the game board. A cooperating second gear means is associated with the cup-like member and is engageable with the first gear means to cause rotation of the cup-like member when the actuating member is moved.

The present invention also provides a method of playing the toy playing game in which a playing piece is moved between a pair of opposed goals on the game board. This method comprises the introducing of the playing piece onto the game board and permitting the playing piece to move downwardly and in arcuate paths toward one or another of the pair of opposed goals on inclined surfaces which lead into the goals. The method further involves the rotating of the cup-like member at either one of said goal areas by manual actuation of an actuating member to cause rotation of a striker member with the cup-like member and thereby engage and propel the playing piece. In this case, the playing piece will automatically enter the cup-like member through any point surrounding the entire periphery of the goal area and in any direction to achieve a score if the striker member does not engage and propel the playing piece away from the goal area.

BRIEF DESCRIPTION OF THE DRAWINGS

Figure 1:
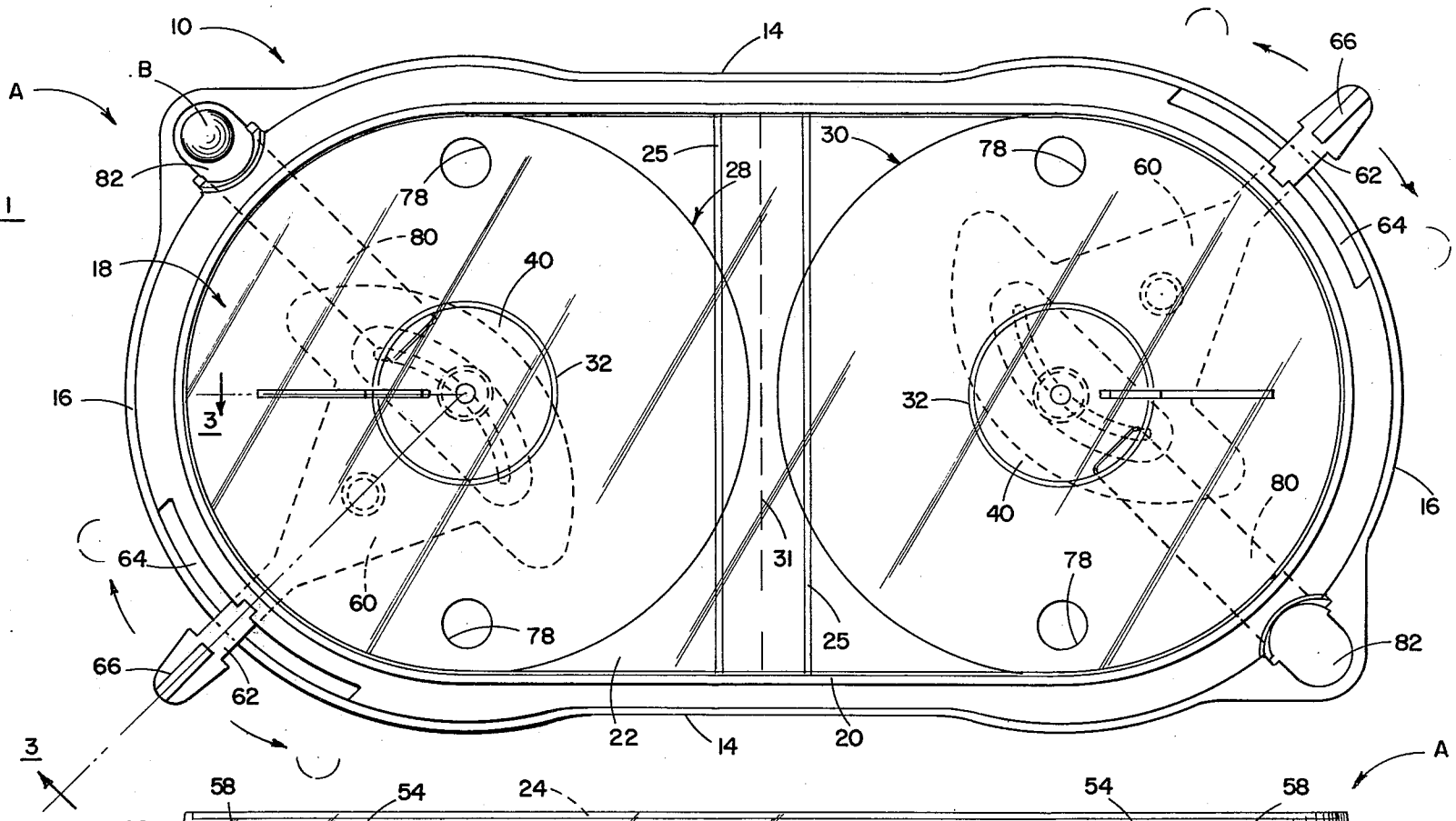
Figure 2:
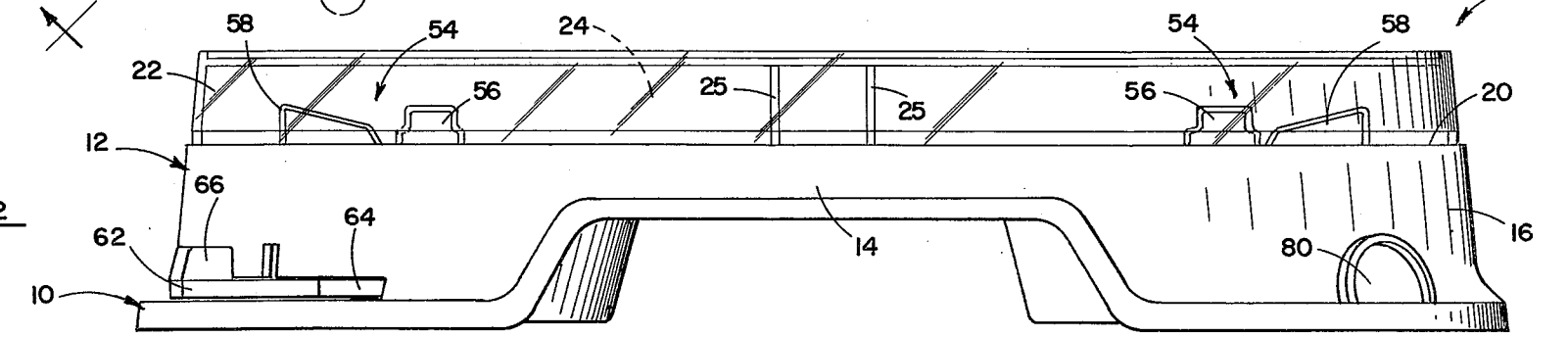
Figure 3:
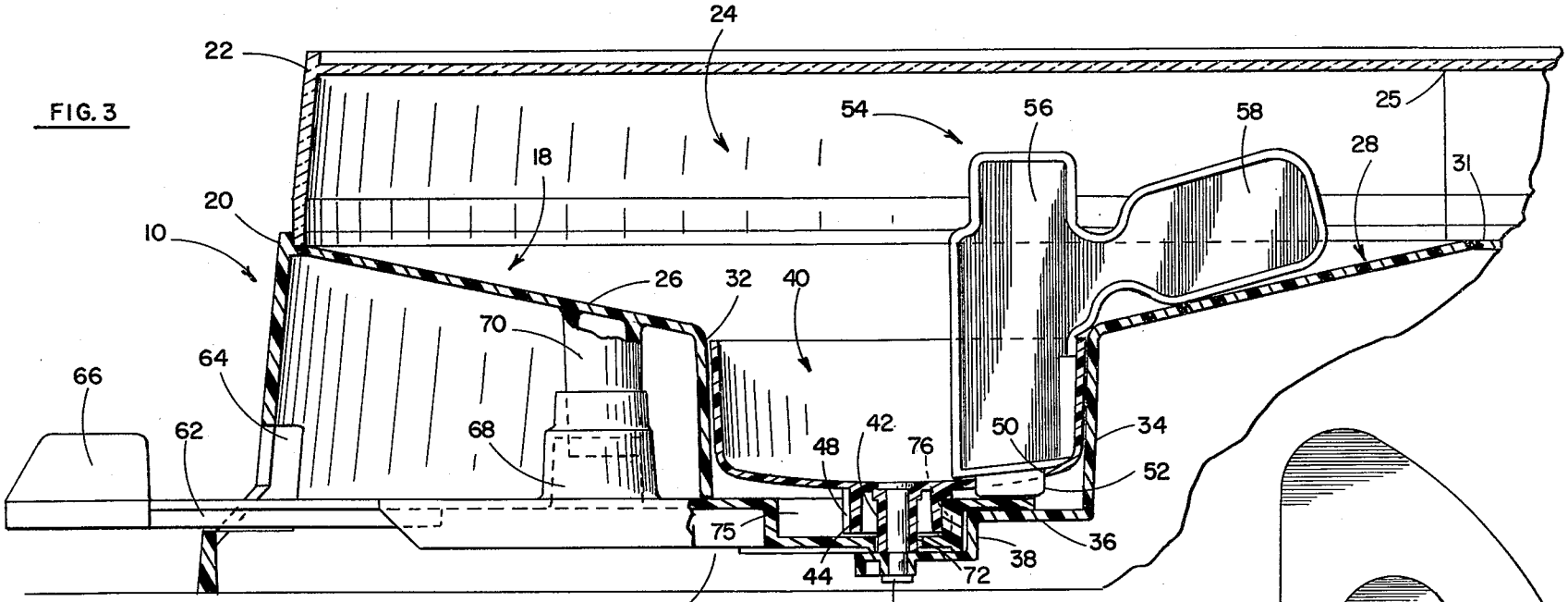
Figure 4:
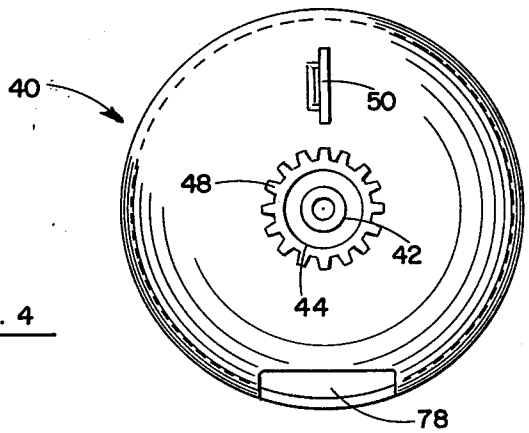
Figure 5:
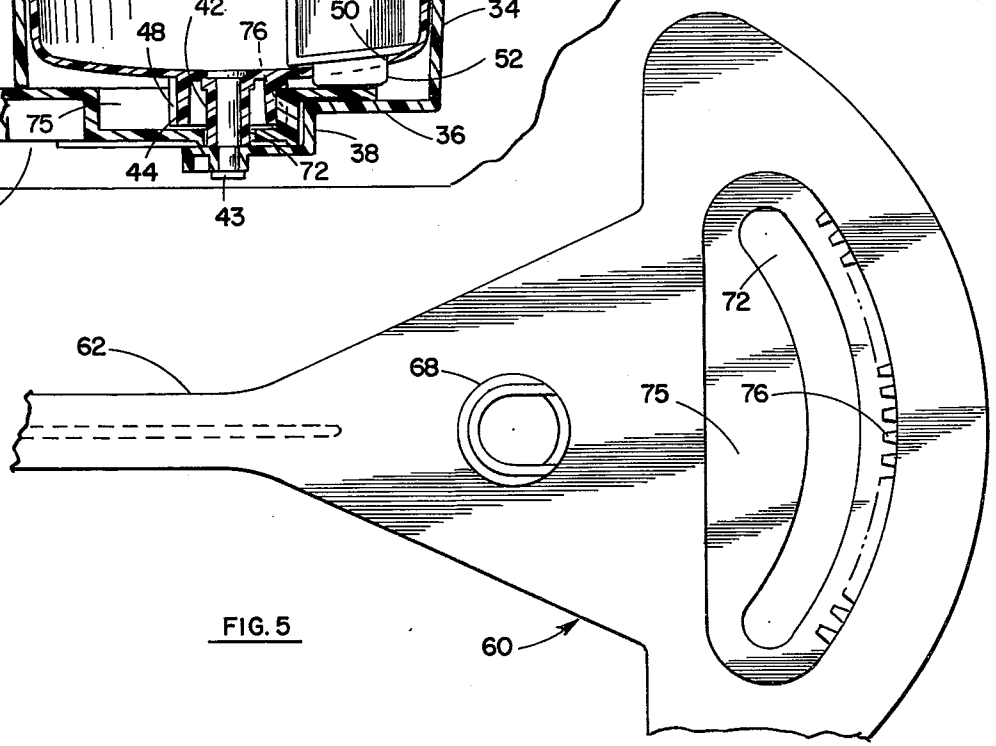

Having thus described the invention in general terms, reference will now be made to the accompanying drawings in which:

FIG. 1 is a top plan view, partially shown in phantom lines, of a toy game apparatus constructed in accordance with and embodying the present invention;

FIG. 2 is a side elevational view of the game apparatus of FIG. 1;

FIG. 3 is a fragmentary vertical sectional view, taken along line 3—3 of FIG. 1;

FIG. 4 is a bottom plan view of a goal cup construction used in the apparatus of the present invention; and FIG. 5 is a fragmentary top plan view of a manually operable actuating member which is utilized in the game apparatus of the present invention.

DETAILED DESCRIPTION

Referring now in more detail and by reference characters to the drawings which illustrate a preferred embodiment of the present invention, A designates a toy game apparatus which in this case is designed to simulate a tennis game, as more fully described hereinafter. However, and as indicated above, the game apparatus of the present invention could be designed to simulate other forms of toy games.

The apparatus A generally comprises a base frame 10 which is integrally connected to and carries a base housing 12, the latter having a pair of longitudinally extending side walls 14 which are connected by somewhat arcuately shaped end walls 16. The base housing 10 is integrally provided with a game playing board 18 and which is hereinafter described in more detail. Moreover, the housing 10 is provided with an upstanding retaining lip 20 for receiving and retentively holding a transparent cover 22 thereon, and which thereby forms a confined playing chamber 24 between the playing board 18 and the cover 22. A pair of transversely extending stripes 25 are painted on or otherwise applied to the interior surface of the cover 22 midway between the longitudinal ends thereof to simulate a tennis net.

The various components forming part of the apparatus A may all be made of conventional plastic materials, such as polyethyene, polystyrene, various vinylidene compounds or copolymers thereof, and the like. As an alternative construction, the various components or some of the components of the apparatus A could be made of other lightweight materials or structural materials such as metals or the like. In the case of the plastic cover 22, this cover is preferably made of a transparent plastic material, such as polymethylmethacrylate, or a similar material.

The playing board 18 includes an upper playing surface 26 and is also formed by a pair of conically shaped sections 28 and 30. One of these conically shaped sections 28 is more fully illustrated in detail in FIG. 3 of the drawings. In this case, it can be observed that the two conically shaped sections 28 and 30 encompass substantially the greater portion of the surface area of the playing board 18. The two conically shaped sections 28 and 30 each comprise inclined walls which extend substantially from the peripheral margin of the playing board and each lead into goal recesses 32. Moreover, it can be observed that each goal recess 32 is located at the bottom of one of the conically shaped surfaces, and is defined by a cylindrically shaped vertically disposed wall 34. Connected to the cylindrically shaped wall 34 is a bottom wall 36 which merges into an axially disposed, downwardly formed retaining bracket 38, as illustrated in FIG. 3 of the drawings.

It can be observed that the two conically shaped sections 28 and 30 essentially merge at a high surface in the game board designated by reference numeral 31, and which is substantially equidistant the two arcuately shaped end walls 16. This high surface 31 is relatively thin in the longitudinal direction, so the playing piece does not become lodged thereon. Moreover, due to the speed of movement of the playing piece, it will always move across the high surface 31 into one or the other of the conically shaped sections 28 or 30.

It can be observed that since the game board 18 is formed of the two conically shaped sections which merge into the goal areas, the playing piece will tend to move in an arcuate path surrounding the goal areas and continuously shift downwardly along the inclined path until it reaches the goal area. Furthermore, it can be observed that since the major surface area of the game board is occupied by the conically shaped areas, the playing piece will not rest anywhere on the playing board and will always shift toward one or the other of the goal areas and, hence, will enter the goal area unless a player of the game actuates a striker member, as hereinafter described, in order to propel the playing piece away from the goal area. In actuality, the playing piece will more fully travel in somewhat of a spiral path toward the goal area. However, the playing piece does move in arcuate path segments and therefore the playing piece is described as moving in an arcuate path.

Disposed within each of the cylindrically shaped goal recesses 32 is a cylindrically shaped goal cup 40 and which is rotatably secured to the downwardly extending bracket 38 by means of a guide rod 42 with a shouldered rivet 43 extending therethrough. Also extending downwardly from the bottom wall of the goal cup 40 is a cylindrically shaped skirt 44 which is spaced from and surrounds the guide rod 42, and mounted on the exterior face of the skirt 44 is a gear 48. In this case, it can be observed that the skirt 44 is of shallower depth than the guide rod 42 and that the skirt 44 and the gear 48 will rotate with the goal cup 40.

Referring now to FIGS. 3 and 4 of the drawings, it can be observed that the bottom wall of the goal cup 40 also includes a slot 50 to receive a tab 52 on an upstanding striker member 54 which is also located within the goal cup 40. The tab 52 is snugly fitted and retained within the slot 50 in order to hold the striker member 54 in the upright position. By further reference to FIG. 3, it can be observed that the striker member includes an upstanding post section 56 and an outwardly struck paddle 58. Moreover, the paddle 58 is angularly inclined upwardly so as to conform to the surface of the game board which surrounds the goal cup 40. In accordance with this construction, it can be observed that as the goal cup 40 is rotated within the goal recess 32, the striker member 54 will rotate therewith. As this occurs, the paddle 58 will also swing around and sweep the area of the game board 18 in proximity to the goal cup 40. Consequently, if the playing element were in this proximity to the goal cup 40, the paddle 58 would engage the playing piece and shift the same away from the goal cup 40.

One form of the playing piece of the present invention is illustrated in FIG. 1 and designated by reference letter B. It should be observed that this playing piece could be of conventional construction and could either adopt the form of a spherically shaped object, such as a ball B, or otherwise it could adopt the form of a relatively flat disc, so as to represent a puck.

The goal cup 40 and the striker member 54 carried therewith are both rotated by means of a manually operable striker actuating mechanism 60 which is more fully illustrated in FIGS. 3 and 5 of the drawings. In this case, the striker mechanism 60 includes an outwardly extending handle 62 which projects outwardly through an aperture 64 formed within the base housing 10 and is provided with an upwardly struck flange 66 for engagement by the player. By reference to FIGS. 1 and 2, it can be observed that an individual actuating mechanism 60 is provided for each of the goal cups 40. Thus, each of the individual players can individually shift the actuating arm 62 in order to move the actuating mechanism 60 and hence rotate the goal cup 40 and the striker member 54 in a manner to be hereinafter described in more detail.

The actuating member 60 includes a cylindrically shaped upstanding boss 68 which is capable of receiving a downwardly extending pivot rod 70 on the underside of the game board 18. In this way, the actuating member 60 is capable of pivoting about the pivot rod 70 within the slot 64. On its inner end, the actuating member 60 is provided with an arcuately shaped aperture 72 in order to accommodate the depending guide pin 42 on the goal cup 40 which carries the gear 48. In addition, the actuating member 60 is also provided with a recess 75 having a gear segment 76 in proximity to and facing the periphery of the arcuate recess 72. The recess 75 is located to receive the lower end of the skirt 44, and the gear segment 76, which functions as a rack gear, is located so as to engage the gear 48. Thus, it can be observed that the enlarged aperture 72 moves relative to the guide pin 42, the gear 48 will be in meshing engagement with the gear segment 76 on the actuating member 60. Furthermore, it can be observed, in accordance with this construction, that when the actuating member is shifted about the pivot rod 70 the gear segment 76 which engages the gear 48 will cause the skirt 44 and the goal cup 40 to rotate. As the goal cup 40 rotates, it will also carry the striker member 54 in its rotations movement therewith.

The paddle 58 is preferably located in a direction of alignment with the longitudinal axis of the game board at the start of a game and is hence capable of being rotated in either direction. Moreover, the striker member 54 is capable of being rotated through a 180° arc in either direction from its rest position shown in FIG. 1, so that, in essence, it can rotate through a 360° arc.

It can be observed that when the player of the game shifts one of the player arms in a clockwise direction, the goal cup 40, and hence the striker member 54 carried therewith, will rotate in a counter-clockwise direction. In like manner, if the actuating arm 62 were moved in the counter-clockwise direction, then the goal cup and the striker member 54 would move in a clockwise direction. Moreover, it can also be observed that if the actuating arm were suddenly stopped in its movement, then the goal cup 40 and the striker member 54 carried thereby would also stop. In essence, the direction of rotation of the goal cup 40 and the striker member 54 is regulated by the direction of movement of the actuating arms 62. Consequently, if the arm 62 is not moving, then the goal cup 40 would not be moving and, hence, the striker member 54 which is secured thereto would also not be moving.

The playing piece is introduced onto the game board 18 by any one of a plurality of apertures 78 located on the cover 22. Thus, if the left-hand player, reference being made to FIG. 1, were serving the playing piece, representative of a tennis ball, then the playing piece would be introduced in either of the apertures 78 on the left-hand of the game apparatus. Conversely, if the player on the right-hand side of the apparatus were serving the playing piece, it would be introduced through either of the two apertures on the right-hand side thereof.

After the playing piece is introduced, the player introducing the playing piece will attempt to actuate its striker member 54 so that the paddle 58 thereof will engage the playing piece and propel the same to the opposite player's goal area. It can be observed that if the opposite player does not take any positive action, the playing piece will continually move through a spiral path in the conically shaped section 28 or 30 and then fall into the goal cup 40 unless the opponent player actuates the actuating member 60 in order to propel the playing piece away from its associated goal area. It can also be observed that if the opponent player does not properly actuate the striker member 54, then the playing piece will automatically enter the goal cup 40 and the original server will achieve a score. However, if the opponent player does engage the playing piece by the paddle 58 of the striker member 54, he will attempt to propel the same across the game board 18 toward the opposite player's goal area. Again, the opposite player will attempt to actuate the actuating mechanism 60 to move the striker member 54 and engage the playing piece with the paddle 58 in order to propel the playing piece away from its goal area. This action will continue until one of the players is able to introduce the playing piece into the opponent's goal cup 40.

Each of the players of the game are required to judge when the playing piece is in the reach of the paddle 58 or otherwise if the player moves the paddle of the striker member 54 too soon or too late, the playing piece may fall into the goal cup. In addition, the player must move the paddle of the goal cup with the desired amount of force and speed. Otherwise, if the playing piece was hit with too fast a speed, it might circle around the other player's side of the game board and come back into the side of the game board of the player who initially hit the playing piece.

It can be observed that each of the players must constantly be alert to the movement of the playing piece since the playing piece will enter into the player's goal cup 40 unless the player takes positive action to move the striker member 54 in order to propel the playing piece away from its goal area. Consequently, it can be realized that skill and strategy are involved in the playing of this game apparatus.

It can also be observed in connection with the present invention that the playing piece can move into either goal cup from any point on the entire peripheral surface of the goal cup, i.e., at any point on the entire 360° circumference of the goal cup. In addition, since the playing piece is moving around the goal cup in an arcuate path and converging downwardly toward the goal cup, it can enter from any direction. Consequently, the defending player must move his striker member to defend the goal area on its entire periphery. Moreover, the defending player can move his striker in either direction, e.g. a clockwise or counterclockwise direction, in order to achieve the best return shot. In this way, each defending player must constantly be alert and exercise the necessary skill to repel the playing piece from his goal area.

Due to the construction of the game apparatus, the game requires not only the skill to defend a goal area open on all points around its periphery, but requires a necessary strategy in the playing to move the playing piece to the opponent's goal area with the most efficient trajectory. In addition, the game is designed so that it is played with the playing piece moving at a significant speed, thereby giving rise to a game which is played at a fairly rapid pace. This also requires a much higher degree of skill and also provides an increased interest to the players of the game.

Since the playing piece is moving in an arcuate path down a somewhat conically shaped surface of constantly reducing diameter toward the goal cups, the speed of movement of the playing piece continually increases as it approaches the goal cup. Thus, the defending player must also take into account the increasing speed of movement of the playing piece as he attempts to repel the same from his goal area and move it into the opponent player's goal area.

In the event that playing piece does not enter a goal cup 40, it will remain in the goal cup 40 until an enlarged aperture 79 formed within the side wall of the goal cup is rotated so that it is in alignment with a discharge chute 80. At this point, the playing piece will move out of the goal cup 40 through the aperture 79 and into the discharge chute 80 which is inclined downwardly into a receiving tray 82, as more fully illustrated in FIG. 1. It should be observed that the same playing piece discharge mechanism is provided for each side of the playing board. When the playing piece has entered into the receiving tray, it may be engaged by either one of the players and introduced into the appropriate aperture 78 for introduction onto the game board 18.

Thus, there has been illustrated and described a unique and novel game playing apparatus which includes a uniquely designed game playing board such that a playing piece will travel through an arcuate path and into a goal area at any point around the entire periphery of the goal area and from any direction unless a player takes positive action to actuate a striker member and propel the playing piece away from the goal area. Accordingly, the game apparatus of the present invention meets all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by letters patent is:

1. A toy game apparatus for engaging and propelling a playing piece into a goal area of an opponent player, said game apparatus comprising:

a. a game playing board, b. a retaining wall extending around said playing board for retaining a playing piece therein, c. a pair of opposed recessed goal areas in said playing board, said game board being of complex curvature such that the goal areas are located at low points in said game board and that the portions of the game board surrounding said goal areas converge downwardly and inwardly toward said goal areas in such manner that the playing piece can move toward the goal areas through arcuate paths surrounding the goal areas and into the goal areas at any point on the entire periphery of the goal areas and from any direction around the goal areas, d. and striker means operatively associated with each of said goal areas to engage and propel said playing piece, and which playing piece will enter a goal area it is approaching if said striker means does not engage and propel said playing piece away from said goal area, each of said goal areas comprising an individual cup-like member and each said striker member being located at each said cup-like member for a rotational movement thereabout.

2. The toy game apparatus of claim 1 further characterized in that an individual manually actuable actuating means is operatively connected to each of said striker means for actuating same.

3. The toy game apparatus of claim 1 further characterized in that a cover member extends over said game board to retain said playing piece thereon.

4. The top game apparatus of claim 1 further characterized in that said toy game apparatus represents a toy tennis game.

5. A toy game apparatus for engaging and propelling a playing piece into a goal area of an opponent player, said game apparatus comprising:

a. a game playing board, b. a retaining wall extending around said playing board for retaining a playing piece therein, c. a pair of opposed recessed goal areas in said playing board, said game board being of complex curvature such that the goal areas are located at low points in said game board and that the portions of the game board surrounding said goal areas converge downwardly and inwardly toward said goal areas in such manner that the playing piece can more toward the goal areas through arcuate paths surrounding the goal areas and into the goal areas at any point on the entire periphery of the goal areas and from any direction around the goal areas, d. and striker means operatively associated with each of said goal areas to engage and propel said playing piece, and which playing piece will enter a goal area it is approaching if said striker means does not engage and propel said playing piece away from said goal area, each said goal area comprising an individual cup-like member for rotational movement in said recessed goal area, and said striker members being operatively mounted for rotation with said cup-like member.

6. The toy game apparatus of claim 5 further characterized in that discharge means are operatively associated with each said cup-like member and being designed to permit discharge of a playing piece in said cup-like member to the exterior of said game board when said cup-like member is in a certain rotational position.

7. A toy game apparatus in which a playing piece can be propelled between a pair of goal areas, said apparatus comprising:

a. a game board comprising:

1. a pair of conically shaped sections extending substantially across the major portion of the surface area of said game board, 2. a recessed goal area at the center of each of said conically shaped sections, 3. each said conically shaped section having a conically shaped wall which converges downwardly and inwardly into said associated goal area and permits a playing piece to enter the goal area at any point and from any direction around the entire periphery of the goal area, 4. said conically shaped sections meeting at an area above the lower portions of said conically shaped sections, and b. striker means at each said goal area to propel a playing piece, each said striker means comprising:

1. a striker member located in proximity to each said goal area and being movable about the entire periphery of said goal area to engage and propel said playing piece, 2. and a manually actuable member to move said striker member.

8. The toy game apparatus of claim 7 further characterized in that a cover member extends over and substantially encloses said game board to retain said playing piece.

9. The toy game apparatus of claim 7 further characterized in that said game board has peripherally extending end retaining walls, and each of said conically shaped sections substantially extend to a pair of opposed end walls.

10. The toy game apparatus of claim 7 further characterized in that said game board is essentially quadrilateral in shape with a pair of longitudinal walls and a pair of arcuate transverse walls, and each said conically shaped section extends toward and ends at each of said longitudinal walls and an individual one of said arcuate transverse walls.

11. The toy game apparatus of claim 7 further characterized in that said cylindrically shaped goal areas each comprises a cylindrically shaped cup disposed therein.

12. The toy game apparatus of claim 7 further characterized in that said game apparatus is a simulated tennis game apparatus.

13. A toy game apparatus for propelling a playing piece between a pair of goal areas to obtain a score by shifting said playing piece in a goal area, said apparatus comprising:

a. a game board having a pair of opposed goal areas therein, b. each of said goal areas having a recessed portion therein, c. a cup-like member disposed in each said recessed portion and capable of receiving said playing piece, d. a manually operable actuating member operatively associated with each said cup-like member and extending beyond said game board, e. first gear means located on a portion of said actuating member inwardly of a peripheral margin of said game board, f. cooperating second gear means operatively associated with said cup-like member and engageable with said first gear means to cause rotation of said cup-like member when said actuating member is actuated, g. and striker means operatively mounted with respect to each cup-like member and being rotatable with said cup-like members to engage and propel said playing piece.

14. The toy game apparatus of claim 13 further characterized in that said toy game apparatus represents a toy tennis game.

15. The toy game apparatus of claim 13 further characterized in that a retaining wall extends around said game board.

16. The toy game apparatus of claim 13 further characterized in that said game board is of complex curvature such that the goal areas are located at low points in said game board and that the portions of the game board surrounding said goal areas converge downwardly and inwardly toward said goal areas.

17. The toy game apparatus of claim 13 further characterized in that said striker means are operatively mounted with respect to each of said goal areas in a location to engage and propel said playing piece and which playing piece will enter a goal area it is approaching if said striker means does not engage and propel said playing piece away from said goal area.

18. The toy game apparatus of claim 13 further characterized in that a cover member extends over said game board to retain said playing piece therein.

19. The toy game apparatus of claim 13 further characterized in that each said striker members are mounted on each said cup-like member for rotational movement about said goal areas.

20. A method of playing a toy playing game in which a playing piece is moved between a pair of opposed goal areas on a game board, said method comprising:

a. introducing a playing piece onto a game board, b. permitting said playing piece to move toward one or another of a pair of opposed goal areas on said game board by force of gravity, c. causing rotation of a striker member at either of said goal areas by manual actuation of an actuating member to engage and propel said playing piece, d. said playing piece automatically entering said goal areas from any point around the entire periphery of each of the goal areas and from any direction to achieve a score if said striker member associated with each goal area does not engage and propel the playing piece away from said goal area, said game board comprising a conically-shaped wall surrounding each said goal area and merging into said goal area so that said playing piece automatically enters the goal area if the striker member associated therewith is not actuated.

21. The method of playing a toy playing game of claim 20 further characterized in that said game is a simulated toy tennis game.

22. A method of playing a toy playing game in which a playing piece is moved between a pair of opposed goal areas on a game board, said method comprising:

a. introducing a playing piece onto a game board, b. permitting said playing piece to move toward one or another of a pair of opposed goal areas on said game board by force of gravity, c. causing rotation of a striker member at either of said goal areas by manual actuation of an actuating member to engage and propel said playing piece, d. said playing piece automatically entering said goal areas from any point around the entire periphery of each of the goal areas and from any direction to achieve a score if said striker member associated with each goal area does not engage and propel the playing piece away from said goal area, said method also comprises automatically discharging a playing piece entering a cup-like member at a goal area when the cup-like member reaches a certain rotational position.

* * * * *

UNITED STATES PATENT OFFICE

CERTIFICATE OF CORRECTION

PATENT NO. : 4037840

DATED : July 26, 1977

INVENTOR(S) : Adolph E. Goldfarb, et al

It is certified that error appears in the above-identified patent and that said Letters Patent are hereby corrected as shown below:

In the Abstract, line 3, after "playing" and before "surface" insert -- piece thereon. The game playing board has a playing --

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*